United States Patent [19]

Dvoracek

[11] Patent Number: 4,961,510

[45] Date of Patent: Oct. 9, 1990

[54] SANITARY LID FOR METAL BEVERAGE CONTAINER

[76] Inventor: Frank Dvoracek, 728 E. Fairmont Rd., Burbank, Calif. 91501

[21] Appl. No.: 420,839

[22] Filed: Oct. 13, 1989

[51] Int. Cl.[5] ..... A47G 19/22

[52] U.S. Cl. ..... 220/90.4; 220/90.6; 220/258; 220/306

[58] Field of Search ..... 220/256, 258, 306, 307, 220/308, 356, 855 P, 90.2, 90.4, 90.6; 215/317, 321; 222/570

[56] References Cited

U.S. PATENT DOCUMENTS

| | | | |
|---|---|---|---|
| D. 165,778 | 1/1952 | Olsen | 220/90.6 X |
| 2,614,406 | 10/1952 | Carpenter | 220/90.6 |
| 2,752,971 | 7/1956 | Tupper | 215/321 X |
| 2,839,229 | 6/1958 | Scheswohl | 220/90.2 X |
| 3,247,993 | 4/1966 | Gelberg-Hanson et al. | 215/321 |
| 3,592,349 | 7/1971 | Baugh | 215/307 |
| 3,734,360 | 5/1973 | Brown | 220/855 P X |
| 3,843,016 | 10/1974 | Bornhorst et al. | 215/321 X |
| 4,243,156 | 1/1981 | Lubbestael | 220/265 X |
| 4,579,257 | 4/1986 | Brandlein | 220/90.2 X |
| 4,679,702 | 7/1987 | Maccarone | 220/90.2 |
| 4,703,873 | 11/1987 | Geren | 220/90.2 X |
| 4,811,860 | 3/1989 | Sorenson et al. | 220/90.4 X |
| 4,865,233 | 9/1988 | Kain | 220/306 X |

FOREIGN PATENT DOCUMENTS

| | | | |
|---|---|---|---|
| 0277562 | 10/1963 | Australia | 220/90.2 |
| 1229426 | 4/1971 | Fed. Rep. of Germany | 220/90.4 |
| 0845457 | 8/1960 | United Kingdom | 220/306 |

*Primary Examiner*—Stephen Marcus
*Assistant Examiner*—Nova Stucker
*Attorney, Agent, or Firm*—Elliott N. Kramsky

[57] ABSTRACT

A spill-proof auxiliary top for a conventional metallic beverage container comprises a unitary molded piece of resilient material that includes a base and a pedestal-like mouthpiece. The mouthpiece is of generally-arcuate shape to conform closely to a consumer's lips. A skirt extends from the base to encircle the can. Tapered sections of the interior of the skirt are arranged for interlocking the upstanding ridge conventionally formed at the top of a beverage can to thereby maintain a secure relationship between the auxiliary top and the can through otherwise-critical tipping angles.

6 Claims, 1 Drawing Sheet

SANITARY LID FOR METAL BEVERAGE CONTAINER

BACKGROUND

1. Field of the Invention

The present invention relates to a lid for facilitating beverage consumption. More particularly, this invention pertains to an improved auxiliary top for a conventional beverage container or can.

2. Backqround of the Prior Art

The aluminum-type can is presently the standard container-dispenser for eight (8) to twelve (12) ounce pre-packaged serving sizes, having overtaken the similarly-sized bottle. Beer, soft drinks, fruit and vegetable juices are commonly packaged in such containers.

This type of container includes two main variants, the "pop-top" and "plain" top while the latter variety requires an opener with sharpened end to pierce the can, the former is provided with an integral, manually-operable feature for effecting an opening or aperture in the lid. With either type, the consumer often wishes to drink directly from the opened. While convenient, such a mode of dispensing the beverage from the container has numerous significant drawbacks. Lack of sanitation is self-evident and notoriously well known. While the beverage inside the can (prior to opening) may be sanitary, the outside of the can, including the region of the opening where the lips must be placed for drinking from a can is rarely sanitary although the exterior of the container may have been reasonably clean upon leaving the factory assembly line. Bacteria, virus, dust, dirt and grease can all contaminate the drinking area after entering a processing chain that can include numerous commercial and personal links. In addition, the edges of the aperture in the top of the can are necessarily sharp due to the sheet-like metal of the lid, subjecting the consumer to discomfort and possible abrasions of the lips and tongue. Finally, the beverage opening in the lid is often poorly matched to the consumer's mouth, making it quite difficult to avoid spillage while drinking.

Numerous attempts have been made to provide an auxiliary element that will function effectively in moderating one or more of the drawbacks of containers of the above-described type. U.S. Pat. Ser. No. 4,679,702 of Maccarone et al. for "Sanitary Drinking Accessory For a Metal Beverage Can" discloses a resilient lip-like accessory for a metal can. The accessory is anchored to a limited edge portion of the can by a tab. U.S. Pat. Ser. No. 4,703,873 of Geren for "Reusable Lid For Beverage Cans" discloses an auxiliary top having an aperture-like spout. A tab is attached to a strap that, in turn, is fixed to the lid for closure. U.S. Pat. Ser. No. 2,839,229 of Scheswohl for "Seamed Metal Container With Plastic Cover For the Seam and Plastic Pouring Spout" discloses a relatively-complex structure that includes a spout which is threaded to a cap. A plurality of ribs radiate from the spout for reinforcing the lid. In addition, numerous variations of the lid-with-spout concept are disclosed for use with an otherwise-open container, such as a coffee cup, in U.S. Pat. Ser. Nos. 4,579,257 of Brandlein for "Closure For Beverage Cans or the Like", 1,229,426 of Carslaw for "Two-handed Cup, Mug or Beaker", 4,767,019 of Horner for "Splash Resistant Cup Lid", 4,243,156 of Lobbestael for "Closure For a Beverage Receptacle", 4,756,440 of Gartner for "Anti-spill Lid For Beverage Container", 4,428,498 of Obey for "Coffee Cup Travel Lid", 4,388,996 of Panicci for "Self-righting Training Cup", 4,353,489 of Arnold et al. for "Combined Lid and Pouring Spout For a Container Having a U-shaped Sealing Channel", Des. 271,858 of Martin et al. for "Can Lid" and Des. 293,083 of Gloor for "Combined Container Lid and Pour Spout".

While each of the innovations disclosed above addresses problems related to one or more of those addressed by the present invention, each has drawbacks insofar as functioning as an effective auxiliary lid or top for a conventional beverage can. That is, in addition to overcoming the problems of direct exposure to the mouth and lips to an unsanitary top, the auxiliary lid should offer a structure that prevents leakage, provides a comfortable, sanitary and drip-free dispenser, and is readily and securely fixable to the top of the beverage container. In contrast with the prior art, the device of the Maccarone et al. patent, for example, is fitted to only a portion of the periphery of the top of the can, and thus does not offer the surety of fixation that one must have when taking into account the fact that the consumer must generally tip the can to a radical angle to remove all of the beverage. The Geren structure is relatively complex and subject to separation from the container when tilted beyond a critical angle and Scheswohl is also complex, utilizing multiple parts that require complex formation. Furthermore, the spout of that device is cylindrical, and does not conform closely to a consumer's lips.

SUMMARY OF THE INVENTION

The present invention provides an auxiliary top for a beverage container of the type that includes a top that is joined to a container body. The top and the body of the container are joined at an upstanding peripheral ridge and the container furthermore has an aperture for permitting beverage flow. The auxiliary top of the invention includes a generally circular base. A pedestal-like member is located adjacent the periphery of the base. Such pedestal-like member has a generally arcuate shape and includes a plurality of apertures at the top. The top comprises a single integral article of resilient material that includes a circumferential skirt for engaging the container. The skirt is joined to a point intermediate the height of the base. The interior of the skirt includes lower and upper portions that taper inwardly to a point intermediate the interior of the skirt to define regions of interior diameter exceeding and less than the outer diameter of the upstanding peripheral ridge.

The foregoing and additional features of the present invention will become further apparent from the detailed written description that follows. This description is accompanied by a set of drawing figures. Numerals of the description, corresponding to those of the drawing figures, point to the various features of the invention, like numerals referring to like features throughout.

DETAILED DESCRIPTION

Figure 1:
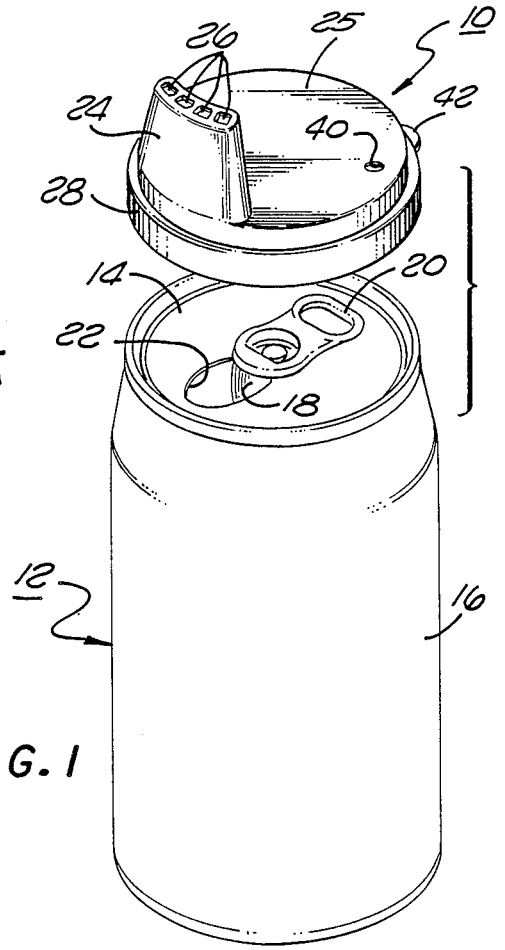
FIG. 1 is a perspective view of the spill-proof auxiliary top 10 of the invention.

FIG. 1 is a perspective view of the spill-proof auxiliary top 10 of the invention. The top 10 is shown juxtaposed relative to a conventional beverage container or can 12 of the pop-top variety. In such a can 12, a top 14 is sealably joined to a container body 16 to enclose the liquid content thereof during transport and storage. An aperture must, of course, be provided in the top 14 for removing the beverage from the can 12. In the case of a pop-top can, an arrangement is provided whereby a portion of the top 14 is scored to define the boundary of a flap 18. A key 20 is secured to the top 14 in such a way that, when flexed upwardly, the flap is separated from the top 14 along the predefined scored boundary and is depressed or bent downwardly to create an aperture 22 of predetermined shape in the top of the can.

An alternate type of can 12 for use with the spill-proof auxiliary top 10 does not employ a pop-top arrangement. Rather, the top 14 of such a can comprises a continuous metal sheet that must be pierced by a conventional can opener. The opener leaves a characteristic V-shaped aperture in the top 14. This aperture is created by the depression of a flap of top 14 material under the force of the lever-like opener.

The auxiliary top 10 may comprise an appropriately-molded unitary construction formed of any resilient material that is not inherently potentially toxic. A variety of known elastomeric and rubberized materials including molded polymers and the like possess adequate strength and resiliency.

A mouthpiece 24 is formed integral with the base 25 of the auxiliary top or lid 10. The mouthpiece 24 is of a generally arcuate shape for a comfortable and close fit with the consumer's lips. It features smooth edges that will not irritate the mouth and is located at a section of the periphery of the circular base 25. A plurality of holes 26 is formed in the top of the tower-like mouthpiece 24 thereby forming multiple beverage flow channels. An aperture 40 in the base 25 permits the equalization of pressure that is required for beverage flow.

Figure 2:
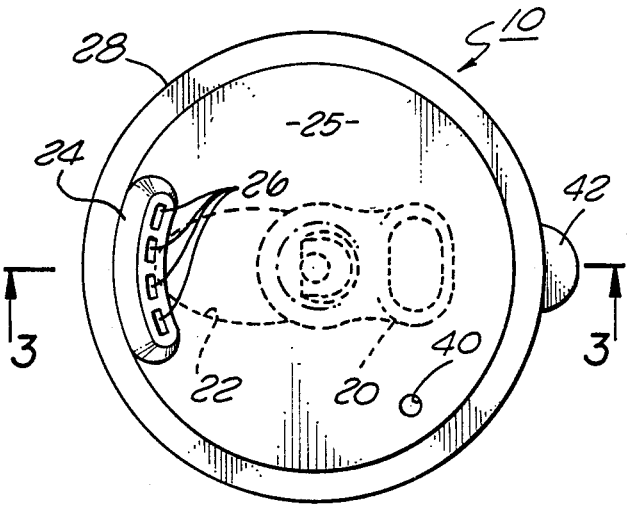
FIG. 2 is a top plan view of the spill-proof top superimposed upon the image of the top of a conventional beverage container.

FIG. 2 is a top plan view of the spill-proof auxiliary top 10 shown superimposed upon the image of the top of the can 12. This view amply contrasts the beverage-and-mouth interface presented by the mouthpiece 24 of the invention with the sharp-edged aperture at the top of a can that the consumer otherwise encounters.

As can be seen, the aperture 22 is spheroidal, bounded by sharp edges and ill-adapted to lips that are necessarily pinched and, perhaps, cut in the process of drinking "straight from the can". (The V-shaped aperture formed by a standard can opener presents the same drawbacks. In fact, due to its location adjacent the periphery of the can and to its straight and narrowing edges, the resultant aperture may pose a greater danger of cutting to both lips and tongue.) Furthermore, since the aperture 22 does not closely match the shape of the user's mouth, a sealing relationship is not established and garment-damaging spillage may occur.

Figure 3:
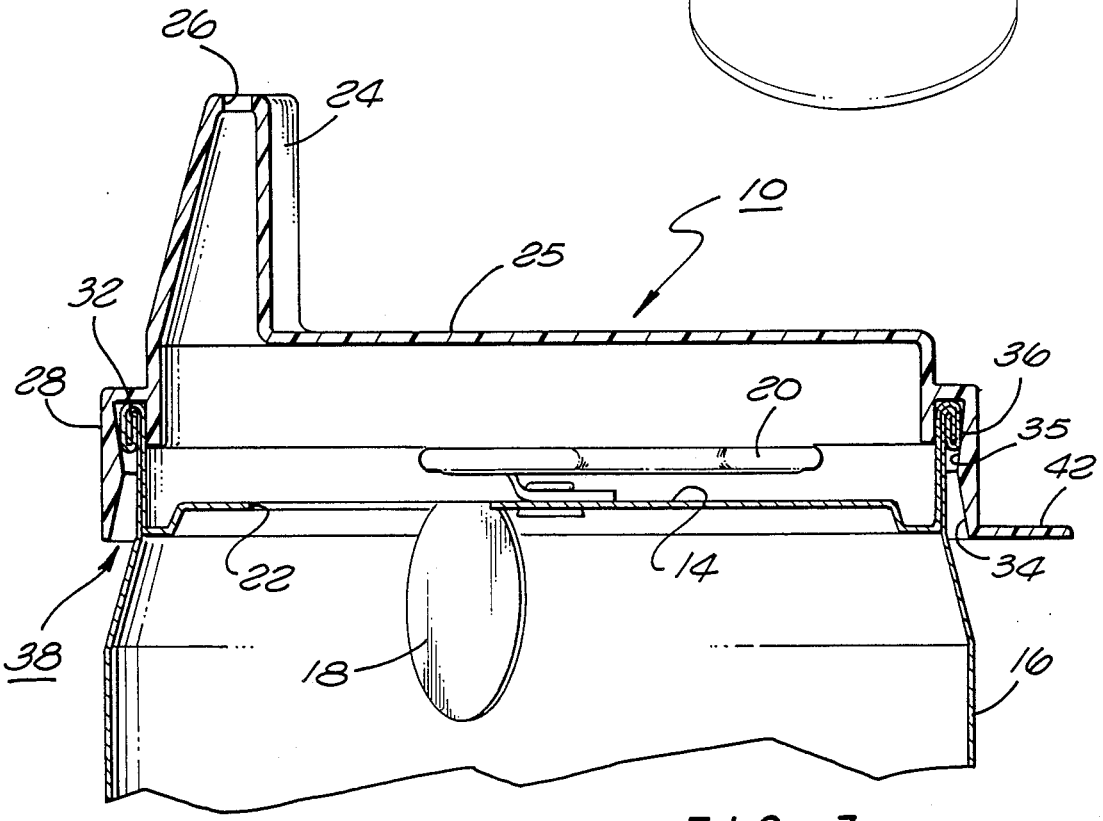
FIG. 3 is a side sectional view of the invention taken at line 3—3 of FIG. 2.

FIG. 3 is a side sectional view of the invention taken at line 3—3 of FIG. 2. As can be seen, the top 10 is a unitary molded piece comprising the pedestal-like mouthpiece 24 joined to the substantially flat base 25. A skirt 28 that adjoins the periphery of the base 26 forms a circular "clip" for interlocking the top 10 to a ridge 32 that is invariably formed by the crimping of the body 16 to the top 14 during assembly of the metal container or can 12.

The auxiliary top 10 includes means for readily and simply and securing the device to the top of the can 12. The inner surface of the skirt 28 comprises two angularly-inclined wall portions, each of which presents the interior of the skirt with a tapered shape. Both the lower wall 34 and the upper wall portions are inclined inwardly toward a point intermediate the height of the skirt 28. As a result, a relatively large "mouth" 38 exists at the bottom of the skirt 28 for fitting the top 10 over the crimped ridge 32. The mouth 38 narrows as the top 10 is pressed down over the ridge. The inner periphery of the resilient top narrows at the aforesaid immediate point to less than the outer diameter of the ridge 32 and thereafter it expands as the top 10 is forced down further to a diameter that exceeds that of the ridge 32. The overall geometry thereby "captures" the ridge 32 with the encircling skirt 28 and sealably secures and fixes the top 10 to the container 12. A tab 42 protrudes outwardly from the skirt 28, facilitating the easy removal of the lid 10 from the can 12. The tab 42 permits one to remove the lid 10 by acting as a lever that is readily manipulated by a thumb or finger. Thus damage to the fingernails is not incurred through use of the lid 10.

Thus, as can be seen, the present invention provides an auxiliary top for a conventional beverage container that offers sanitation, protection from lip abrasion and spillage that would otherwise be experienced without such a device. Furthermore, the device is simple, readily and fixedly secured to the top of a container in such a way that one need not be concerned with critical tipping angles. Thus, the consumer may use the device freely and without fear of spillage.

While this invention has been disclosed with reference to its presently preferred embodiment, it is not limited thereto. Rather, this invention is limited only insofar as defined by the following set of claims and includes all equivalents thereof.

What is claimed is:

1. An auxiliary top for a beverage container of the type that includes a container top that is joined to a container body, said top and said body being joined at an upstanding peripheral ridge and having an aperture for permitting beverage flow therethrough, said auxiliary top comprising, in combination:
   (a) a generally circular base;
   (b) a pedestal-like member located adjacent the periphery of said base;
   (c) said pedestal-like member having a generally arcuate shape and including a plurality of apertures at the top thereof;
   (d) said top comprising a single integral article of resilient material that includes a circumferential skirt for engaging said container;
   (e) said skirt being joined to a point intermediate the height of said base; and
   (f) the interior of said skirt including lower and upper portions that taper inwardly to a point intermediate the interior of said skirt to define regions of internal diameter exceeding and less than the outer diameter of said upstanding peripheral ridge.

2. An auxiliary top as defined in claim 1 wherein said pedestal-like member has four symmetrically-arranged apertures.

3. An auxiliary top as defined in claim 2 further characterized in that:
   (a) a tab is joined to said circumferential skirt; and
   (b) said tab extends radially therefrom.

4. An auxiliary top as defined in claim 3 wherein said tab is formed integral with said skirt.

5. An auxiliary top as defined in claim 4 wherein said tab is joined to the bottom of said skirt.

6. An auxiliary top as defined in claim 5 wherein said tab is generally semi-circular.

* * * * *